United States Patent [19]

Elmore et al.

[11] Patent Number: 4,721,526

[45] Date of Patent: Jan. 26, 1988

[54] HEAP LEACHING WITH OXYGEN

[75] Inventors: Carl L. Elmore; Phillip Mitchell, both of Glens Falls, N.Y.; Robert J. Brison, Golden, Colo.

[73] Assignee: Kamyr, Inc., Glens Falls, N.Y.

[21] Appl. No.: 895,977

[22] Filed: Aug. 13, 1986

[51] Int. Cl.[4] ..... C22B 11/04

[52] U.S. Cl. ..... 75/118 R; 75/105; 423/29; 423/30; 423/31; 266/168

[58] Field of Search ..... 266/168, 101 R; 75/101 R, 105, 118 R, 2; 423/27, 29, 30, 31

[56] References Cited

U.S. PATENT DOCUMENTS

| | | | |
|---|---|---|---|
| 2,009,667 | 7/1935 | Keyes | 423/29 |
| 4,190,436 | 2/1980 | Hughes | 75/105 |
| 4,256,705 | 3/1981 | Heinen et al. | 423/27 |
| 4,526,615 | 7/1985 | Johnson | 75/101 R |

FOREIGN PATENT DOCUMENTS

| | | |
|---|---|---|
| 3126234 | 4/1983 | Fed. Rep. of Germany . |
| 78/1184 | 7/1978 | South Africa . |

OTHER PUBLICATIONS

Davidson, R. J. et al, "The Intensive Cyanidation of Gold-Plant Gravity Concentrates", J. of South African Inst. of Min. and Metal., Jan., 1978, pp. 146-165.

"On the Dissolution of Precious Metals . . . ", Tronev et al., Comptes Rendus (Doklady) de l'Academie des Sciences (1937), vol. 16, No. 5, pp. 281-284.

"Chemistry of Cyanidation . . . ", Hedley et al., American Cyanamid Company, Dec. 1968.

"The Chemistry of the Extraction of Gold . . . ", Gold Metallurgy in South Africa, Finkelstein, Chapter 10, p. 309 (1972).

"Research on Pressure Leaching of Ores . . . ", Pietsch et al., Erzmetall, Jun. 1983, pp. 261-265.

"The Treatment of Refractory Gold-Bearing . . . ", Muir et al., Precious Metals: Mining Extraction and Processing, 1984, pp. 309-322.

"Solubilities of Inorganic and Metal-Organic Compounds (Seidel)", Linke, 4th Ed., 1958, vol. 1, p. 250, vol. 2, pp. 1228-1230.

Skillings I, Skillings Minning Review, vol. 75, No. 26, Jun. 28, 1986, pp. 3-10.

Skillings II, Skillings Minning Review, May 25, 1985 pp. 4-7.

McClelland I, Dept. of the Interior Report 8612 "Improvements in Heap Leaching . . . ", 1981.

McClelland II, Dept. of the Interior Circular 8945, "Agglomeration-Heap Leaching . . . ", 1983.

Arthur et al, "Development of a Small Scale . . . ", pp. XXIV-1, 3, 5, 7, 9, 11, 13, 17, 19 and 21.

Potter I, "Some Factors in the Design of . . . ", 1980.

Potter II, "Extraction of Metallurgy 1981", "Some Developments in Gold. . . ", pp. 128-136.

McQuiston et al, "Gold and Silver Cyanidation . . . ", pp. 3-9, 1981.

Chamberland I, "Minning Congress Journal", Apr., 1981, Heap Leaching . . . , pp. 47-52.

Chamberland II, "Gold and Silver Leaching . . . ", Department of Interior Information Circular 8852.

Kappes, "Leaching of Small Gold and Silver Deposits", Nov., 1978, pp. 1-18.

Sawyer, "Process Design and Operation . . . ", pp. C187-191.

Duncan et al, Engineering and Minning Journal, Jul., 1977, pp. 65-72, "How Cortez Gold Mine . . . ".

*Primary Examiner*—Robert L. Stoll

*Attorney, Agent, or Firm*—Nixon & Vanderhye

[57] ABSTRACT

A method and system for the percolation leaching of gold and silver ores applies a cyanide leaching liquid to a pile of gold and silver ore. Heap leaching, vat leaching, or the like may specifically be practiced. The cyanide leaching liquid is applied to the pile by spraying, flooding, or via a foam of oxygen gas and cyanide liquid on top of the pile. Gold and silver are recovered from the pregnant liquor. The leach rate is increased and/or the recovery of gold and silver from the ore is increased by supplying to the pile a gas containing oxygen at a significantly higher percentage than in ambient air (e.g. pure oxygen gas). The oxygen gas may be supplied to the leaching liquid, and/or into the pile itself (as with a plurality of perforated pipes adjacent the bottom of the pile).

19 Claims, 4 Drawing Figures

HEAP LEACHING WITH OXYGEN

BACKGROUND AND SUMMARY OF THE INVENTION

Pile leaching of gold and silver ores has been increasing in popularity since pile leaching techniques can be practiced with low capital and operating costs, and may be cost-effective for use with low grade ores. "Pile leaching" as used in the present specification and claims covers what are conventionally known as heap leaching processes, vat leaching processes, and like processes in which a pile of ore particles or the like have a cyanide leaching liquid applied thereto, with recovery of pregnant liquor from the bottom of the pile. The term "ore" as used in the present specification and claims covers tailings, uncrushed ore, crushed ore, agglomerated crushed ore, and the like. Pile leaching normally encompasses the percolation leaching of relatively coarse gold-siver ore piled on a surface which allows collection of the pregnant liquor obtained from the percolation leaching.

According to the invention it has been found that the leach rate can be increased, and/or the recovery can be increased in the same total leach time, by utilizing oxygen in the leaching process. That is oxygen containing gas, having a significantly higher precentage of oxygen therein than is obtained utilizing ambient air, is supplied to the pile. This may be practiced by introducing oxygen containing gas, such as "pure oxygen" (e.g. gas having about 99 percent oxygen) into bottom portions of the pile utilizing a plurality of pipes having gas passages therein. Additionally, or alternatively, the oxygen can be supplied to the pile by adding the oxygen to the cyanide leaching liquid that is applied to the pile to leach the gold and/or silver from the ore into the pregnant liquor. An ejector may be utilized to add the oxygen gas to the liquid prior to applying it to the pile, as by spraying it on top of the pile (particularly where heap leaching is utilized), flooding the top of the pile (particularly where vat leaching is practiced), or applying it as a foam (the oxygen gas and cyanide leaching liquid foaming) on top of the pile.

While the invention is applicable to a wide variety of "ores", as that term is used in the present specification and claims, it is particularly advantageous for use in leaching gold from those ores which typically consume oxygen and therefore tend to deplete the oxygen from leached solutions in conventional systems. Where agglomeration of the ore particles is desirable, that may be practiced utilizing any desirable conventional technique, such as shown in U.S. Pat. No. 4,256,705.

The gold and/or silver may be recovered from the pregnant liquor utilizing a number of conventional techniques. For instance the pregnant liquor may be withdrawn from adjcent the bottom of a heap and then treated by a carbon-adsorption system or a zinc precipitation system, or it may be withdrawn from the bottom of a rock filter of a vat leaching apparatus, and similarly treated by carbon-adsorption or zinc precipitation.

By practicing the present invention, it is possible to significantly increase the leach rate, or to increase recovery in the same total leach time, or a combination of both. Because of the increased leach rate that may be obtained by utilizing oxygen in the practice of the invention, the flow of solution to a pile could be increased to maintain the same gold concentration in solution, or, alternatively, the flow could be maintained at the same rate as in conventional pile leaching, resulting in a higher concentration of gold in solution (and thereby permitting a smaller recovery system).

It is the primary object of the present invention to enhance the effectiveness of pile leaching of gold and silver ores. This and other objects of the invention will become clear from an inspection of the detailed description of the invention and from the appended claims.

DETAILED DESCRIPTION OF THE DRAWINGS

Figure 1:
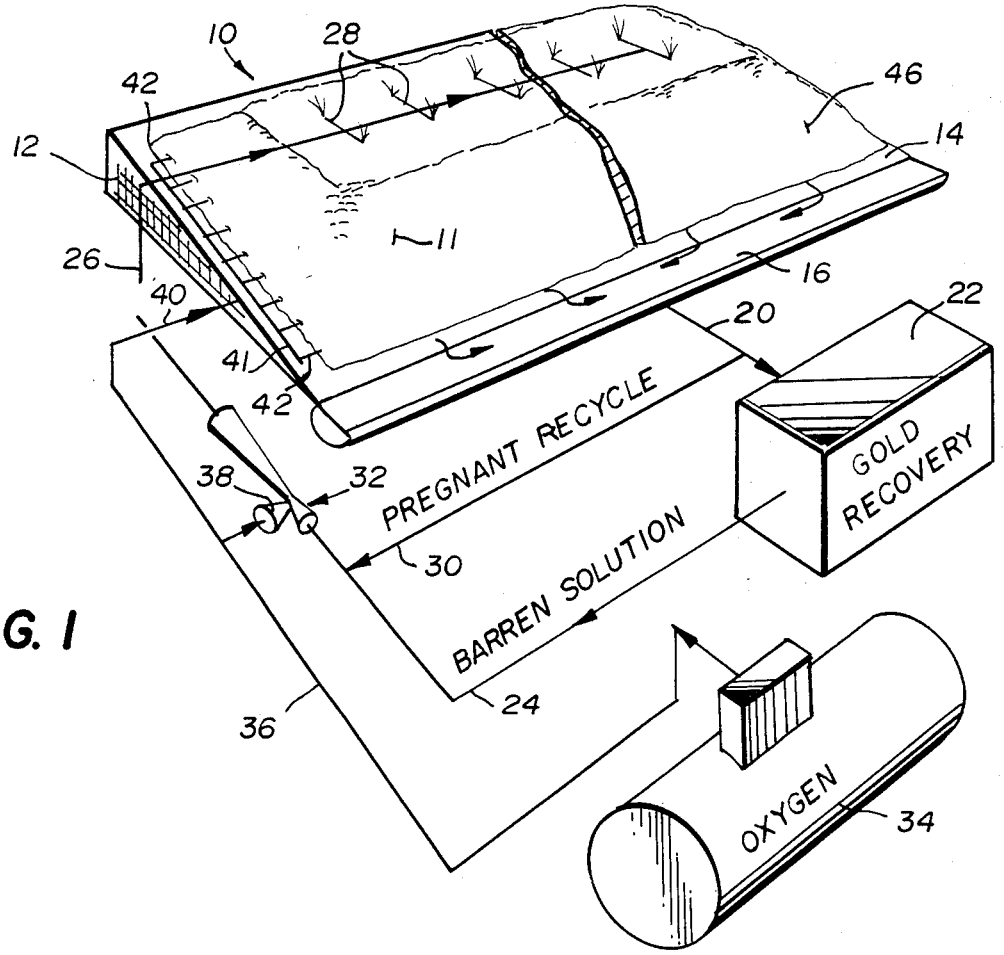
FIG. 1 is a perspective schematic view of exemplary apparatus for practicing a heap leaching method according to the present invention.

An exemplary heap leaching system for practicing a method of heap leaching of gold and silver ore according to the present invention is illustrated schematically by reference numeral 10 in FIG. 1. Ore 11 is heaped in any suitable conventional manner on a sloping leach pad 12. The leach pad 12 may be of conventional design, having a substantially impervious surface 14 on which the ore 11 is heaped, such as a plastic heap laid over a prepared surface, a reusable pad, a locally-obtained clay lined pad, etc. The impervious surface 14 of the pad 12 is sloping, such as illustrated in FIG. 1, having a higher portion and a lower portion, and pregnant liquid is withdrawn from the lower portion, as utilizing the conventional pregnant solution trough 16. The pregnant liquid passes via conduit 20 to a conventional gold recovery station 22, which may comprise a conventional carbon-adsorption system, a conventional zinc precipitation system, or the like. The barren solution (cyanide leaching liquid) from the gold recovery station 22 passes in line 24 ultimately to be applied to the ore pile 11 via line 26 in conventional sprayheads 28, or the like. Desirably a portion of the pregnant liquor is recycled from line 20 to line 24 via line 30.

According to the present invention, the leach rate and/or the recovery of gold or silver in the same total leach time, is achieved by supplying oxygen to the ore in the pile 11. Oxygen gas is supplied which has a significantly greater percentage of oxygen therein than does ambient air; desirably, "pure oxygen" is utilized, that is oxygen gas having a purity approaching about 99 percent or so, however gases having lower percentages of oxygen, but higher than in ambient air, also will be effective. The oxygen gas is supplied from a tank of oxygen, 34, via line 36. The oxygen gas can be supplied to the ore in pile 11 by one of, or both of, two ways.

According to a first procedure, the oxygen gas from source 34 is applied to the cyanide leaching liquid in line 24 utilizing a conventional ejector 32, the oxygen gas being supplied to the suction 38 of the ejector 32. Preferably enough oxygen gas is supplied to essentially saturate the leaching liquid with oxygen gas.

Figure 2:
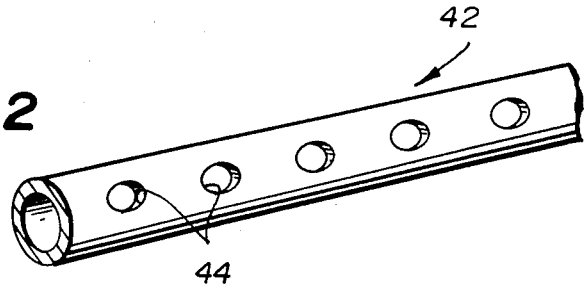
FIG. 2 is a perspective detail view of a portion of an exemplary oxygen introducing pipe utilizable in the system of FIG. 1.

Alternatively, or additionally, the oxygen gas is applied to the pile 11 utilizing line 40, connected to line 36, header 41, and pipes 42. The pipes 42 are disposed adjacent the bottom of the pile 11, and extend substantially the length thereof. The pipes 42 have gas passages, such as illustrated by the openings 44 in FIG. 2, therein. The passages 44 are designed with respect to the size of particles expected to be provided in the pile 11, so that the particles of ore do not readily clog the passages 44. Any suitable construction of passages can be provided in order to effect the desired results, such as by providing the entire pipes 42 of gas porous sintered material or the like, providing the passages in the side or bottoms of the pipe, etc. A second plurality of pipes, perpendicular to pipes 42, may also be provided adjacent the bottom of the pile and connected to tank 34.

Optionally, according to the invention, a cover 46 may be provided on top of the pile 11. The cover 46 would be formed of gas impermeable plastic, or the like, which would prevent or minimize diffusion of oxygen out of the pile 11. An oxygen atmosphere could be maintained beneath the cover 46, and/or the leaching liquid could be applied by spraying it on top of the cover 46 (if the cover were water permeable while still preventing or minimizing diffusion of oxygen therethrough).

Figure 4:
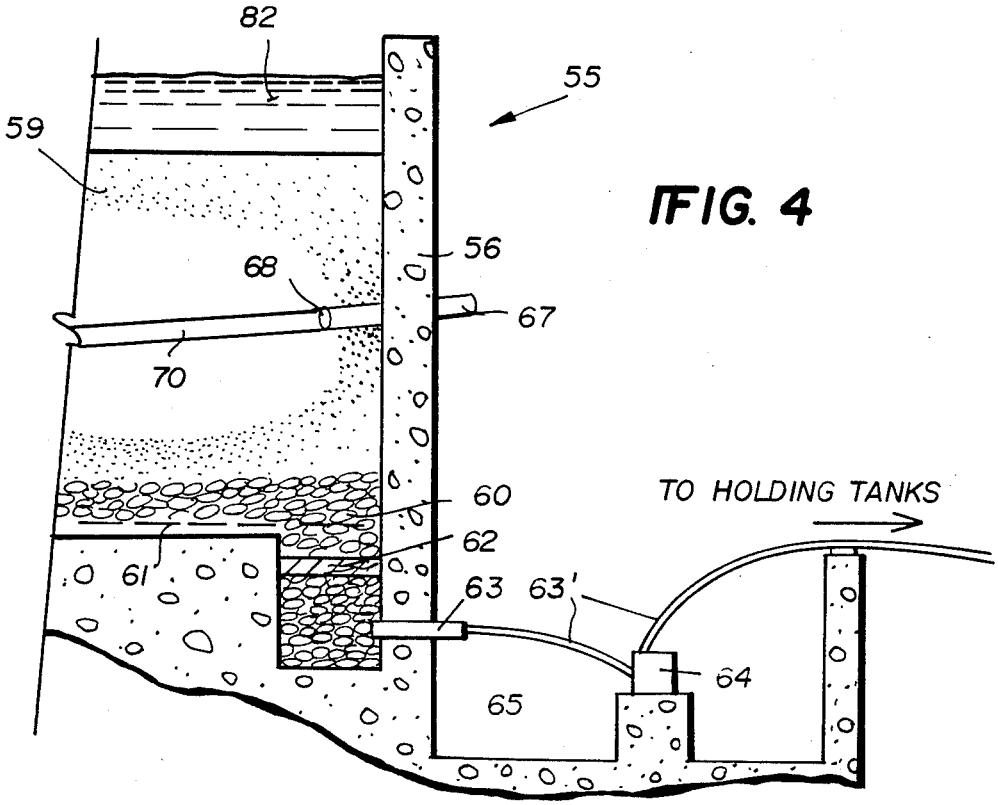
FIG. 4 is a partial, side, cross-sectional view illustrating equipment utilized with one of the vats schematically illustrated in FIG. 3.
Figure 3:
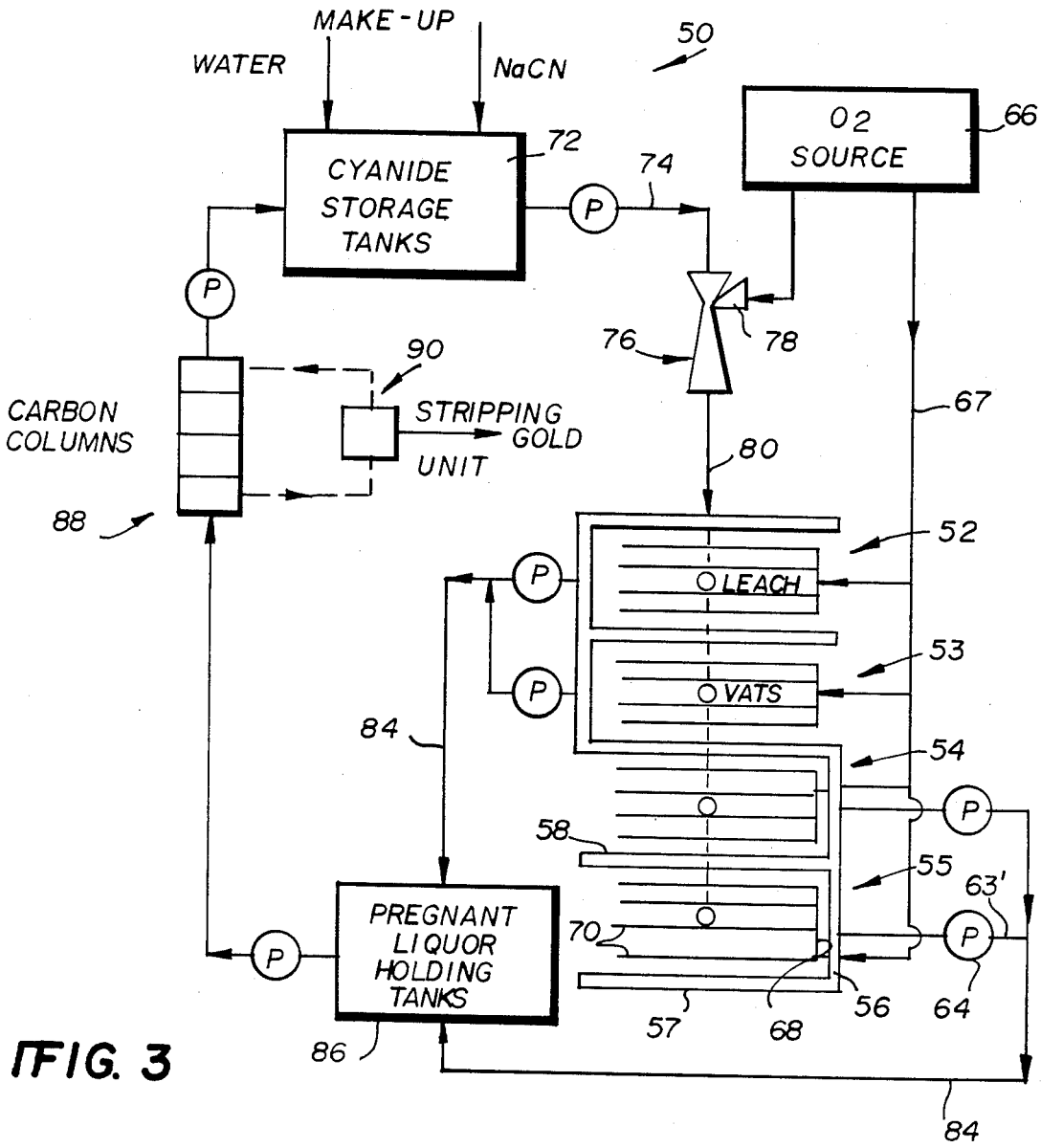
FIG. 3 is a box diagram illustrating an exemplary system for the preactive of vat leaching according to the method of the present invention.

FIGS. 3 and 4 illustrate the practice of an exemplary method according to the invention in a process conventionally referred to as vat leaching. An exemplary system for practicing this process is illustrated generally by reference numeral 50 in FIG. 3 and preferably includes a plurality of vats 52, 53, 54, and 55. A typical vat, such as the vat 55, has an end wall 56, and sidewalls 57, 58. At least a portion of the bottom of the vat slopes downwardly from the open end between the walls 57, 58, toward the wall 56. The bottom of the vat 55 typically would contain rocks 60 providing a rock bed or filter, a layer of burlap 61, a wood support 62 or the like, and a filter 63 below the support 62 and burlap 61. The ore is provided in a pile 59 above the rocks 60. Pregnant liquor is withdrawn from the bottom of the rocks 60 via the filter 63 into lines 63', pump 64 pumping the pregnant liquid from the vat 55. A sump 65 is provided adjacent the filter 63.

According to the present invention, oxygen is supplied to the pile 59 from oxygen source 66, as via line 67 which is connected up to individual headers 68 within each vat (e.g. vat 55), with a plurality of pipes 70 extending from each header 68. The pipes 70 have gas passages therein, as described above with respect to pipes 42. The pipes 70 may be provided adjacent the bottom of the pile 59, to introduce oxygen gas into the pile 59 so that it flows generally upwardly therein.

Alternatively, or additionally, oxygen gas is supplied to the pile 59 by adding it to the cyanide leaching liquid from storage tank 72, which passes in line 74. An ejector 76 in line 74 has oxygen supplied to the suction 78 thereof, the outlet 80 from the ejector 76 applying the leaching liquid to each of the vats 52–55. In this particular embodiment, the cyanide leaching liquid is typically applied to the piles 59 by flooding; for example see the liquid 82 above the ore 59 in FIG. 4. Alternatively, the oxygen gas and cyanide liquid could be caused to foam, and the material 82 above the ore pile 59 could be a foam.

The pregnant liquor from each of the lines 63' associated with the vats 52–55 passes into lines 84, which ultimately pass to pregnant liquor holding tanks 86. From there the liquor is passed to a recovery station, as to the carbon columns 88 having stripping unit 90 associated therewith, from which the gold (and/or silver) is recovered.

While exemplary apparatus has been utilized in order to describe the process according to the invention, it will be understood that other types of apparatus also may be utilized. The method, in its broadest concepts, envisions the percolation leaching of gold and silver ore by practicing the following steps: (a) Piling leachable gold and silver ore (as defined above) into a pile. (b) Applying a cyanide leaching liquid to the pile to leach gold and silver from the ore into a pregnant liquor. (c) Supplying gas to the pile, the gas containing oxygen in an amount greater than in ambient air, to increase the leach rate or recovery, of gold and silver. And, (d) recovering gold and silver from the pregnant liquor, as by withdrawing the pregnant liquor from the bottom of the pile and subjecting it to carbon-adsorption or zinc precipitation techniques, or the like. While the invention is applicable to all types of "ores", as defined above, it is particularly applicable to the recovery of gold from those ores which tend to consume oxygen.

It will thus be seen that according to the present invention an effective method for the percolation leaching of gold and silver from ore piles has been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods, procedures, and systems.

What is claimed is:

1. A method for increasing the total amount of gold or silver recoverable in pile leaching gold or silver ore comprising the steps of:

(a) piling leachable gold or silver ore into a pile;

(b) applying a cyanide leaching liquid to the pile adjacent the top thereof to leach gold or silver from the ore into a pregnant liquor;

(c) supplying gas to the pile, the gas containing an amount of oxygen greater than in ambient air, said gas being supplied adjacent the bottom of the pile such that at least part of the gas flows countercurrently to the cyanide leaching liquid and remains in gaseous form thereby to increase the total leached yield or amount of gold or silver recovered at the completion of the leaching process in comparison with the total leached yield or amount of gold or silver recovered using air as the supplied gas; and (d) recovering gold or silver from the pregnant liquor.

2. A method as recited in claim 1 wherein the method is heap leaching, and wherein step (a) is practiced by piling ore particles on a sloping pad having a high end portion at an elevation enabling flow of pregnant liquor to a low end portion of said pad, and wherein step (d) is practiced by withdrawing pregnant liquor from the low end portion of the pad.

3. A method as recited in claim 2 wherein step (b) is practiced by spraying the cyanide leaching liquid onto the top of the heap.

4. A method as recited in claim 2 wherein step (c) is practiced by adding oxygen gas to the cyanide leaching liquid before applying the leaching liquid to the pile.

5. A method as recited in claim 4 wherein step (c) is practiced by saturating the cyanide leaching liquid with oxygen gas.

6. A method as recited in claim 5 wherein step (c) is further practiced by introducing pure oxygen gas, into the bottom of the pile.

7. A method as recited in claim 4 wherein step (c) is practiced by adding the gas to the liquid utilizing an ejector.

8. A method as recited in claim 2 wherein step (c) is practiced by introducing pure oxygen gas, directly into the bottom of the pile.

9. A method as recited in claim 8 wherein step (c) is further practiced by providing a plurality of pipes adjacent the bottom of the pile, the pipes having gas passages therein, and introducing the oxygen gas into the pile through the gas passages in the pipe.

10. A method as recited in claim 2 wherein step (b) is practiced by spraying the liquid onto a water permeable cover covering the heap.

11. A method as recited in claim 1 wherein the ore consumes oxygen, and wherein steps (a) through (d) are practiced to recover gold.

12. A method as recited in claim 1 wherein the method comprises vat leaching, and wherein step (a) is practiced by piling the ore on a rock bed, and wherein step (d) is practiced by withdrawing the pregnant liquor from the bottom of the vat, below the rock bed.

13. A method as recited in claim 12 wherein step (b) is practiced by flooding.

14. A method as recited in claim 12 wherein step (c) is practiced by adding oxygen gas to the cyanide leaching liquid before applying the leaching liquid to the pile.

15. A method as recited in claim 14 wherein step (c) is further practiced by introducing pure oxygen gas into the pile itself.

16. A method as recited in claim 12 wherein step (c) is practiced by introducing gas containing pure oxygen gas directly into the pile itself.

17. A method as recited in claim 16 wherein step (c) is further practiced by providing a plurality of pipes adjacent the bottom of the pile, the pipes having gas passages therein, and introducing the oxygen gas into the pile through the gas passages in the pipe.

18. A method as recited in claim 1 wherein steps (b) and (c) are practiced by applying oxygen gas and cyanide leaching liquid as a foam to the top of the pile.

19. A method as recited in claim 1 wherein step (c) is practiced by covering the pile to minimize the loss of oxygen from the pile, and pure oxygen gas is introduced below the covering, into the pile.

* * * * *